United States Patent [19]

Helling et al.

[11] Patent Number: 4,548,887

[45] Date of Patent: Oct. 22, 1985

[54] DYE DIFFUSION TRANSFER PROCESS WHEREIN PROTEOLYTIC ENZYME DECOMPOSES LIGHT SENSITIVE ELEMENT

[75] Inventors: Günter Helling, Odenthal; Wolfgang Himmelmann, Leverkusen, both of Fed. Rep. of Germany

[73] Assignee: AGFA-Gevaert A.G., Leverkusen-Bayerwerk, Fed. Rep. of Germany

[21] Appl. No.: 627,557

[22] Filed: Jul. 3, 1984

[30] Foreign Application Priority Data

Jul. 16, 1983 [DE] Fed. Rep. of Germany ..... 3325762

[51] Int. Cl.[4] ..... G03C 5/54; G03C 1/40; G03C 7/26

[52] U.S. Cl. ..... 430/213; 430/215; 430/217; 430/236; 430/237; 430/238; 430/463; 430/256

[58] Field of Search ..... 430/213, 215, 217, 236, 430/237, 238, 256, 212

[56] References Cited

U.S. PATENT DOCUMENTS

| | | | |
|---|---|---|---|
| 3,575,703 | 4/1971 | Judd et al. | 430/230 |
| 3,620,737 | 11/1971 | Etter et al. | 430/264 |
| 3,721,558 | 3/1973 | Abbott et al. | 430/213 |
| 4,150,977 | 4/1979 | Phillips | 75/118 P |
| 4,379,828 | 4/1983 | Liebe et al. | 430/213 |

FOREIGN PATENT DOCUMENTS

| | | | |
|---|---|---|---|
| 2016906 | 5/1970 | France . | |
| 1179769 | 1/1970 | United Kingdom | 430/252 |

OTHER PUBLICATIONS

H. M. Barchet, Habilitation Thesis of the Math Nat. Faculty of the University of Leipzig.

Research Disclosure 16,101, McConalogue et al., 9/1977, p. 4.

*Primary Examiner*—Richard L. Schilling

*Attorney, Agent, or Firm*—Connolly and Hutz

[57] ABSTRACT

Colored dye diffusion images are produced using a recording material containing, on a layer support (layer element 1), a first dye absorbent layer (layer element 2), a light-sensitive element containing silver halide emulsion layers and color-providing compounds (layer element 3) and optionally a second dye absorbent layer (layer element 4), in that order. An imagewise distribution of diffusible dyes is produced in the light-sensitive element in the course of development and transferred to the first dye absorbent layer.

The light-sensitive element is then decomposed by a treatment which decomposes its layers, e.g. by means of a proteolytic enzyme, but leaves the first dye absorbent layer intact. The second dye absorbent layer optionally present, which has a lower mordanting capacity than the first dye absorbent layer and serves to prevent contamination of the developer bath with diffusible dyes, is also decomposed.

8 Claims, No Drawings

DYE DIFFUSION TRANSFER PROCESS WHEREIN PROTEOLYTIC ENZYME DECOMPOSES LIGHT SENSITIVE ELEMENT

This invention relates to a photographic dye diffusion transfer process for the production of colour images and to a colour photographic recording material suitable for this purpose. The material contains, on a layer support, a dye absorbent layer capable of being coloured by diffusible dyes and, above this layer and detachable therefrom, a light-sensitive element in which an imagewise distribution of diffusible dyes is produced in the course of development to an extent depending on the previous imagewise exposure and is transferred to the dye absorbent layer. An additional dye absorbent layer may be provided above the light-sensitive element.

The process comprises at least one treatment step in which the light-sensitive element, optionally together with the layers situated above it, is removed from the dye absorbent layer after development.

DE-A No. 2 647 480 discloses a process in which the image dyes released in the course of development are transferred from a light-sensitive element to a dye absorbent layer below this element by diffusion, whereupon the lightsensitive element is detached from the dye absorbent layer (image receptor layer), optionally with the aid of mechanical forces. A so-called stripping layer may be placed between the light-sensitive element and the dye absorbent layer to facilitate detachment of the light-sensitive element, but the use of such stripping layers also has its disadvantages. One general disadvantage is that a stripping layer requires the use of an additional support material to enable the superfluous layers to be completely stripped from the image receptor layer and transferred to a recycling process. If the stripping layers consist of a hydrophobic material which has little tendency to swell, the stripping process is difficult and in many cases requires the use of mechanical aids such as brushes in addition to a washing treatment. This again entails the risk of damaging the image receptor layer. If, on the other hand, the stripping layer is hydrophilic with a strong tendency to swell, the stripping process itself may be simple to carry out but such stripping layers undergo considerable swelling while the photographic material is still at the stage of development, with the result that the distance which the released dyes must travel along the paths of diffusion is increased to an unacceptable extent and the sharpness of the image is therefore impaired. When no stripping layers are employed and the layers to be separated are removed solely by mechanical force, the risk of damage to the image receptor layer is, of course, increased.

The treatment of photographic recording materials with enzymes is already known. The enzymes are used mainly for the recovery or isolation of components which are not enzymatically decomposable (e.g. U.S. Pat. No. 4,150,977, Research Disclosure 16 101, 1977). It is also known that enzymes, in particular proteinases, can be used for the production of lithographic printing plates. In such processes, silver halide gelatin layers which have been exposed imagewise are subjected to a tanning development followed by a washing out treatment using a proteinase (BE-A No. 737 104). Lastly, it is known that photographic recording materials can be decomposed layer by layer by means of enzymes. This method is used for example, for analytical purposes (e.g. H. M. Barchet, Habilitation thesis of the Math. Nat. Faculty of the University of Leipzig) or for reproduction purposes (e.g. GB-A No. 1 179 769).

It is an object of the present invention to provide a dye diffusion transfer process for processing a recording material containing, on a layer support, a dye absorbent layer capable of being coloured by diffusible dyes (image receptor layer) and, above this layer, a light-sensitive element which contains at least one spectrally sensitized silver halide emulsion layer and colour-providing compounds and can be removed after development, the dye absorbent layer and the light-sensitive element being constituted in a particular manner and the process also being carried out in a particular manner so that the light-sensitive element and any layers optionally arranged above it can be separated from the dye absorbent layer arranged on the layer support without this separation entailing the disadvantages normally associated with the stripping process.

It has been found that removal of the light-sensitive element after development can easily be achieved by a layer decomposing treatment, e.g. a heat treatment or treatment with an enzyme, and poses no problems, if the layer materials for the dye absorbent layer on the one hand and the layers of the light-sensitive element on the other hand are chosen so that they differ considerably in the ease with which they can be decomposed by the treatment, the dye absorbent layer undergoing comparatively little decomposition by the treatment while the layers of the light-sensitive element are comparatively easily decomposed.

The present invention relates to a photographic dye diffusion transfer process for the production of colour images, in which a colour photographic recording material consisting of a layer support and, arranged on this support, a combination of layers comprising at least one dye absorbent layer capable of being coloured by diffusible dyes, a light-sensitive element which is detachably connected with the dye absorbent layer and contains at least one spectrally sensitized silver halide emulsion layer, and at least one colour-providing compound associated with this layer, is exposed imagewise and developed, whereupon the light-sensitive element is separated from the dye absorbent layer, characterized in that the recording material is subjected to a layer decomposing treatment after development and that the recording material used is one whose light-sensitive element is decomposed by the layer decomposing treatment while the dye absorbent layer arranged on the layer support withstands this treatment.

The layer decomposing treatment may consist, for example, of a treatment with an enzyme, in particular a proteolytic enzyme, if the binder of the layers of light-sensitive element consists predominantly of proteinaceous binders such as gelatin. In that case, the dye absorbent layer may be prepared from materials which do not contain any bonds capable of being split by the enzyme used or of materials whose susceptibility to decomposition by the enzyme used has been reduced or eliminated by additional measures such as hardening or cross-linking.

The invention also relates to a colour photographic recording material suitable for carrying out the process according to the invention.

According to the invention therefore, a recording material consisting of a layer support, a dye absorbent layer and light-sensitive layers containing colour-providing compounds is treated after its development, for example by means of a bath containing a suitable enzyme, so that the binder of the light-sensitive layers is sufficiently decomposed to enable the components of the light-sensitive layers to be completely detached from the dye absorbent layer and accumulate in the treatment bath.

The binder used in the layers of the light-sensitive element may be one of the conventional hydrophilic, colloidal binders but gelatin is by far the most preferred and has up to now proved to be virtually indispensible as a binder for photgraphic silver halide emulsions as well as for other photographic layers.

The layer decomposing treatment should be adapted to the nature of the binder used and, conversely, the materials of the dye absorbent layer and of the light-sensitive element should be selected according to the layer decomposing treatment envisaged. If the binder of the layers of the light-sensitive element are proteinaceous substances e.g. gelatin, it is suitable to use proteolytic enzymes (proteinases) such as trypsin, pepsin, papain or pancreatin.

The enzyme is suitably used in the form of an aqueous bath containing the enzyme at a suitable concentration and optionally adjusted by means of buffers to a suitable pH for maximum proteolytic activity. The optimum conditions are easily determined by the skilled person by a few routine preliminary tests. For example, when the layers contain gelatin it has been found suitable for the purposes of the invention to use a 2% aqueous trypsin solution adjusted to a pH of 8 to 8.5.

While the layers of the light-sensitive element are completely decomposed by the layer decomposing treatment, the material of the dye absorbent layer should be affected as little as possible by this treatment. This is important because the optical characteristics, such as sufficient colour density, colour saturation and contour sharpness or the mechanical properties such as strength, in particular abrasion resistance and freedom from tackiness, would otherwise be impaired. This object may be achieved, for example, by using an enzyme for the layer decomposing treatment and by using, as a binder for the dye absorbent layer, one which is not decomposed, or very much less so, by the particular enzyme used than the binder of the light-sensitive layers, or by using dye absorbent image receptor layers which are completely free from binders. Examples of binders which are not decomposed by proteolytic enzymes and therefore suitable for the dye absorbent layer include, for example, cellulose derivatives as well as other naturally occurring, synthetic or semi-synthetic high molecular weight compounds which do not have a peptide structure. On the other hand, the dye absorbent layers used may be completely free from binder, i.e. layers which contain no binder other than the dye mordants which are necessarily present. Suitable examples of such layers include, for example, those prepared from cross-linkable or cross-linked, film forming mordanting polymers, as described, for example, in GB-A No. 1 594 961 or GB-A No. 2 011 912.

Binders which do have a peptide structure but have been treated by special hardening processes to reduce their decomposition by the enzyme used so that it is very much less than that of the layers of the light-sensitive element are also suitable for the dye absorbent layer.

As already mentioned above, the main importance lies in the difference in the extent to which the layers are decomposed by the layer decomposing treatment. According to the present invention, the layers are decomposable to such an extent that the light-sensitive element is completely removed after dye transfer while the dye absorbent layer remains intact on the layer support. A sudden change in the tendency to decomposition therefore occurs at the interface between the light-sensitive element and the dye absorbent layer. Suitable layer materials for the dye absorbent layer and for the layers of the light-sensitive element may be determined by means of a test in which the layers are immersed in a bath of a 2% aqueous trypsin solution adjusted to pH 8 to 8.5 and maintained at 40° C. Whereas the layers of the light-sensitive element preferably dissolve and become completely detached from their support after 2 minutes' treatment in the bath described above, the layer materials used for the dye absorbent layer are preferably capable of withstanding a treatment in this bath for at least 15 minutes without any sign of dissolving.

An assessment of the comparative ease of decomposition of the layers of the light-sensitive element and the comparative resistance to decomposition of the dye absorbent layer depends to an important extent on the moment in time at which the layer decomposing treatment occurs. Since, according to the invention, the layer decomposing treatment is preceded by an alkaline development, the ease of decomposition may be influenced in the desired direction by this development. For example, the alkaline development treatment may be capable of releasing, within a certain layer of the colour photographic material, certain substances which accelerate or retard the action of the proteolytic enzyme used for the layer decomposing treatment. Information on suitable activators or inhibitors for the enzymatic decomposition of gelatine may be found, for example, in the work "The Hydrolysis of Gelatin by Proteolytic Enzymes and their Use in Photographic Emulsion Preparation" by R. E. Jacobson in R. J. Cox "Photographic Gelatin", Academic Press 1976. At the same time, the susceptibility of a certain layer to decomposition may also be improved by the alkaline development treatment if the binder contained in this layer has been cross-linked by hydrolyzing cross-linking agents.

Although, in the process described in GB-A No. 1,179,769, a photographic layer is also subjected to enzymatic treatment, this treatment is carried out for the purpose of partial decomposition of the binder at the surface of the layer while the structure of the layer is to remain intact. Moreover, the process described there is not a diffusion transfer process and the material used therefore contains no dye absorbent layer. By contrast, according to the present invention, the light-sensitive element is completely dissolved by the enzymatic treatment and thereby removed from the dye absorbent layer below it, which contains the desired transfer colour image, and the layer structure of the light-sensitive element originally present is completely lost. This finds its expression not only in a completely different arrangement of layers in the recording material according to the present invention but also in correspondingly different conditions for the enzymatic treatment.

The layer decomposing treatment may also be carried out by methods not using enzymes. A suitable recording material for this purpose, for example, may contain, on a layer support, a dye absorbent layer capable of being coloured by diffusible dyes and cross-linked with alkali stable hardeners so that the layer is not decomposed by hydrolytic methods such as the action of alkali (pH 12–14) and after-treatment with hot water. The lightsensitive element in which the diffusible dye is produced imagewise is placed above this layer, solubly bonded thereto, and is hardened with a temporary cross-linking agent which is destroyed by alkali. The combination of layers is resistant to hot water before processing but is brought into contact with alkaline activator solution at pH 12 to 14 for 1 to 2 minutes in the course of processing so that the hydrolysable cross-linked areas dissolve. Rinsing with hot water produces a differentiation between the soluble, removable light-sensitive layers of the light-sensitive element and the non-removable dye absorbent layer.

The temporary cross-linking agent (HL) which is unstable to alkali may in principle be any cross-linking agent in which the reactive groups in the molecule are separated by groups which are unstable to alkali (Compounds of the 1st type) or whose reaction products with gelatin are unstable in the presence of alkali (Compounds of the 2nd type).

The following are examples of temporary cross-linking agents of the first type:

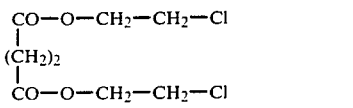
HL-1

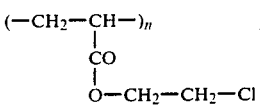
HL-2

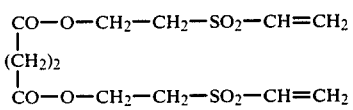
HL-3

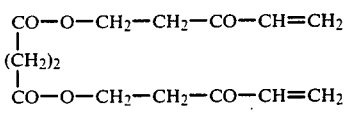
HL-4

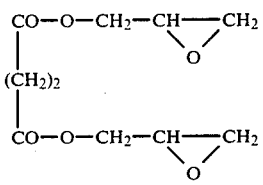
HL-5

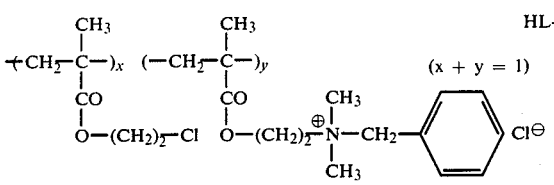
HL-6

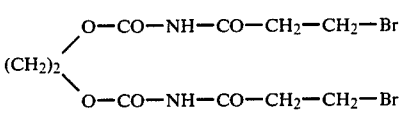
HL-7

The following are examples of temporary crosslinking agents of the second type:

Bis- and polyepoxides

-continued

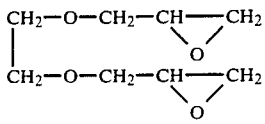
HL-8

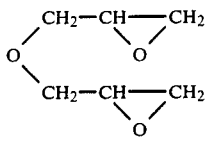
HL-9

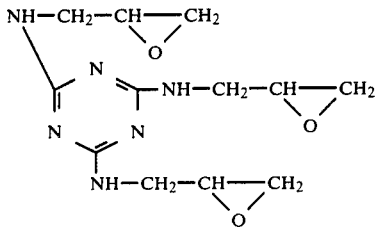
HL-10

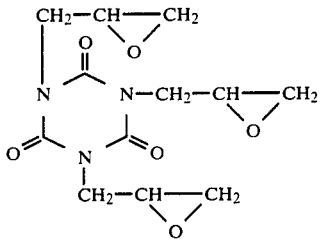
HL-11

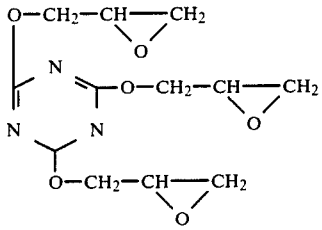
HL-12

Bis- and polyhalogenacetamides

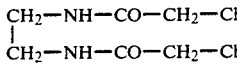
HL-13

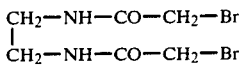
HL-14

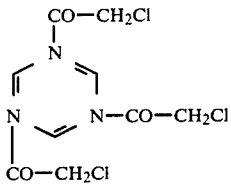
HL-15

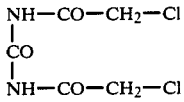
HL-16

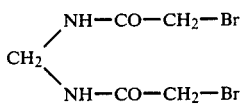
HL-17

-continued

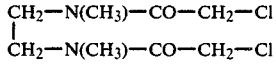

HL-18

The differentiation in cross-linking may be enhanced by using non-hardenable gelatin derivatives such as acetyl gelatin or phthaloyl gelatin in addition to pure gelatin in the emulsion layers of the light-sensitive element and only pure gelatin in the dye absorbent layer.

The following are examples of alkali stable hardeners (HS):

HS-1 formaldehyde
HS-2 dimethylolurea
HS-3 vinyl sulphones
HS-4 1,3,5-triacryloyl-perhydro-1,3,5-triazine
HS-5 mucochloric acid
HS-6 hydroxydichlorotriazine

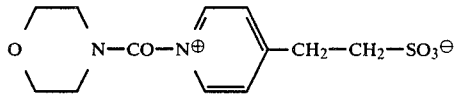

HS-7

In an advantageous embodiment of the present invention, the photographic recording material carries an additional dye absorbent layer above the light-sensitive element. This additional layer contains, like the above-mentioned first dye absorbent layer, a mordant for the diffusible coloured compounds which are released in the course of development and converted into a soluble form. Since these diffusible dyes are predominantly anionic dyes, it is preferred to use basic or cationic mordants which are capable of fixing the dyes in the form of salts.

The mordants used both for the above-mentioned, first dye absorbent layer and the the additional, second dye absorbent layer optionally present may be chosen from among the mordants conventionally used, including both soluble mordants and cross-linked latex mordants such as those described, for example, in U.S. Pat. No. 2,882,156, DE-A No. 2 315 304, GB-A No. 1, 412 131, GB-A No. 1 400 727, DE-A No. 2 516 408, U.S. Pat. No. 3,859,096, U.S. Pat. No. 4,124,386, DE A No. 2 631 621 and DE-A No. 2 652 464 and Research Disclosure 22 840 (August 1982).

The first and second dye absorbent layers differ in their mordanting capacity since the first dye absorbent layer, which is arranged closer to the layer support, contains a comparatively strong mordant while the second dye absorbent layer, further removed from the support, contains a comparatively weak mordant, so that the first dye absorbent layer has a comparatively high mordanting capacity and the second layer a comparatively low mordanting capacity. The term "comparatively" refers to the relation between the two dye absorbent layers. The advantage of this preferred embodiment is that, while the major proportion of the diffusible dyes released in the course of development is transferred to the first dye absorbent layer, namely the image receptor layer, the second dye absorbent layer has the effect of preventing small quantities of released diffusible dye from entering the developer bath by diffusion and causing undesirable discolouration which would make the developer bath unusable for processing any further material.

To ascertain whether a mordant is suitable, its mordanting strength may be determined by means of a test described in DE-A No. 2, 445 782, in which a comparison constant K is determined for the relative mordanting strength of each of the mordants under investigation by dividing the colour densities which are obtained in a Test sheet A and a Comparison sheet B when a solution of dye is distributed between these two sheets placed with their active surfaces in contact. Test sheet A and Comparison sheet B each consist of a transparent layer support with a layer of mordant applied thereto, covered by a layer of binder containing a light-reflecting pigment such as $TiO_2$. The mordant layer of Test sheet A contains the mordant under investigation while the mordant layer of Comparison sheet B contains a standard mordant, such as a polyvinyl imidazolium salt.

The dye solution distributed between the two sheets A and B may be, for example, a liquid containing 40 g of hydroxyethylcellulose per litre and adjusted to pH 14 with KOH and in addition containing a suitable dye, e.g. a yellow, magenta or cyan dye or a dye mixture. The comparison constant K is then calculated from the equation $$K = \frac{D_A}{D_B}$$

where $D_A$ and $D_B$ are the reflection colour densities in the mordant layers of the two sheets A and B placed together, measured in each case through the transparent layer support. If the same standard mordant is always used in Comparison sheet B, the K-values obtained are a direct measure of the mordanting strength of the mordant used in Test Sheet A.

According to the advantageous embodiment of the present invention described above, the first dye absorbent layer, which is closer to the layer support, contains a mordant of comparatively high mordanting strength compared with that of the second dye absorbent layer, which is further removed from the layer support. This means that, in the test described above, the mordant contained in the first dye absorbent layer is found to have a higher K-value than the mordant in the second dye absorbent layer. In other words, in this particular embodiment, the mordants used in the preparation of the recording material according to the invention are so chosen that a mordant with a higher K-value is used for the first dye absorbent layer and a mordant with a lower K-value for the second dye absorbent layer. The ratio of K-values of the mordants in the two dye absorbent layers should conform to the equation $$\frac{K_I}{K_{II}} > 1$$

and preferably $$10 > \frac{K_I}{K_{II}} > 1.5$$

where $K_I$ is the K-value of the mordant in the first dye absorbent layer and $K_{II}$ the K-value of the mordant in the second dye absorbent layer.

Whereas the first dye absorbent layer should be to a large extent resistant to the layer decomposing treatment, the second dye absorbent layer should be capable of decomposing substantially to the same extent in this decomposing treatment as the layers of the light-sensitive element. The second dye absorbent layer should thus conform substantially to the same criteria of decomposability as the layers of the light-sensitive element, which means that when proteolytic enzymes are used for the decomposing treatment, the binders to be considered for the second dye absorbent layer are mainly proteinaceous binders, in particular gelatin, and the degree of hardening is also generally kept low so that the decomposability will remain substantially unimpaired.

The colour photographic recording material according to the present invention may in the simplest case, for example in the case of decomposition by an enzyme, may comprise the following main layer elements:

1. A layer support;
2. a (first) layer (image receptor layer) capable of being coloured by diffusible anionic dyes and comparatively resistant to decomposition when treated with an enzyme;
3. a light-sensitive element comparatively easily decomposed when treated with an enzyme and comprising at least one light-sensitive silver halide emulsion layer and a non-diffusible, colour-providing compound associated with this layer, which compound releases diffusible anionic dyes imagewise as a consequence of development.

In the particularly advantageous embodiment of the invention mentioned above, an additonal dye absorbent layer having a comparatively low mordanting capacity, i.e. in comparison with the first dye absorbent layer, and a capacity for decomposition comparable to that of the light-sensitive element, is situated as layer element 4 above the light-sensitive element (layer element 3).

Apart from the main layer elements 1 to 3 mentioned above and the additional layer element 4 preferably also present, the recording material according to the invention may, of course, also contain photographic auxiliary layers such as backing layers, intermediate layers, protective layers, filter layers, neutralization layers or layers containing an opacifying agent or other photographic auxiliary substances such as developing agents, stabilizers or substances capable of accelerating or retarding the enzymatic decomposition.

The layer support (layer element 1) may consist of one of the usual transparent or opaque layer supports, depending upon the intended use of the material. Suitable transparent layer supports include, for example, films of cellulose esters, polyethylene terephthalate, polycarbonate or other film-forming polymers, but opaque layer supports are preferred, in particular paper, optionally provided with hydrophobicizing surfaces, e.g. polyethylene-laminated paper or pigmented materials, in particular organic films containing a white pigment, e.g. so-called white cello.

The (first) dye absorbent layer (layer element 2) substantially has the characteristic of comparatively low capacity for decomposition by enzymatic treatment and this determines the choice of suitable binders or the preparation of this layer in a binder-free form. Binders, if used for this layer, are chosen according to the invention so that they are comparatively unaffected by the enzymes used. In such cases, the dye absorbent layer contains either binders which are free from peptide bonds, such as cellulose derivatives or derivatives of polyvinyl alcohol, or binders which do contain peptide bonds but in which the degradability has been considerably reduced by certain additional measures, such as hardening. The mordant contained in the dye absorbent layer is adjusted to the nature of the diffusible dyes released from the light-sensitive element. Since these are generally anionic dyes, it is preferred to use mordants having cationic or basic groups. The first dye absorbent layer may consist, for example, of a layer of mordant produced by photo-induced cross-linking (GB-A No. 1 594 961).

The light-sensitive element (layer element 3) is also an essential constituent of the colour photographic recording material according to the invention. In the case of a single dye transfer process, it contains a light-sensitive silver halide emulsion layer and a colour-providing compound associated with this layer. The colour-providing compound may be situated either in a layer adjacent to the silver halide emulsion layer or directly in the silver halide emulsion layer. For producing multicoloured transfer images with faithful colour reproduction, however, the light-sensitive element generally contains three such associations of colour-providing compound with light-sensitive silver halide emulsion layer, and the absorption range of the image dye obtained from the colour-providing compound generally corresponds substantially to the range of spectral sensitivity of the associated silver halide emulsion layer. It may be advantageous for obtaining very high sensitivity to arrange the colour-providing compound in a separate layer of binder situated behind the silver halide emulsion layer (viewed in the direction of the incident light used for exposure) or to use a colour-providing compound whose absorption is different from that of the resulting image dye (e.g. "shifted image dyes"—U.S. Pat. No. 3,854,945). Alkali permeable separating layers are generally provided between the various associations of differently spectrally sensitized silver halide emulsion layers and colour-providing compound, the main function of these separating layers being to prevent colour falsification. Such separating layers are particularly effective if they contain compounds capable of inactivating the diffusible developer oxidation products.

The colour-providing compounds used in the light-sensitive element may be soluble and diffusible in the alkaline developer medium and progressively immobilized imagewise with progressive development of the silver halide, e.g. so-called dye developers, or they may be compounds originally present in a diffusion-fast form in the layers and capable of releasing diffusible dyes in their reduced or oxidized form as a result of development (dye releasers). For information on colour-providing compounds, reference may be made to the survey given in the article by Van de Sande, "Dye Diffusion Systems in Color Photography" in Angew. Chem. Int. Ed. Engl. 22, 191–209 (1983).

The dye absorbent layer (layer element 4) optionally present above the light-sensitive elements contains, like the first dye absorbent layer already mentioned above, a mordant for the released dyes, generally a mordant containing basic or quaternized groups. This second dye absorbent layer differs from the first dye absorbent layer, firstly in that it is comparatively easily decomposed by the enzyme treatment and secondly in that it has a comparatively lower mordanting capacity for the dyes released on development.

The photographic recording material according to the invention has been designed for treatment in a liquid aqueous bath (developer or activator bath, aftertreatment bath) and therefore carries no further layer support on the side of the light-sensitive element remote from the above mentioned layer support.

The process according to this invention, i.e. processing of the material according to the invention, generally covers the stages of development and after-treatment for removal of the layers arranged above the first dye absorbent layer to reveal the transferred colour image.

When the development takes place, the uniform distribution of colour-providing compound initially present gives rise to an imagewise distribution of diffusible dyes, a substantial proportion of which reaches the first dye absorbent layer by diffusion and is fixed there.

Development may be carried out in an aqueous processing bath containing the alkali required for development and optionally also the necessary developer substances although the latter may, in known manner, be contained partly or completely in layers of the colour photographic recording material, in which case a simple activator bath containing alkali may be used for development. The presence of a second dye absorbent layer is found to be advantageous for processing the material according to the invention since it prevents part of the diffusible dyes released in the course of processing from entering the developer bath or activator bath. The risk of contamination of the developer bath by the dyes released is thereby reduced to a minimum. On the other hand, development may be carried out by application of a layer of a viscous developer paste, e.g. by distributing such a paste between the colour photographic material according to the invention and a development auxiliary sheet placed over it. After completion of development, the development auxiliary sheet is removed and any residues of developer still adhering to the uppermost layer of the colour photographic recording material according to the invention may be washed off.

A layer decomposing treatment now follows, e.g. the treatment with an enzyme for the purpose of decomposing and removing the layers no longer required after development , i.e. the layers of the light-sensitive element and, if present, the second dye absorbent layer above it. An aqueous treatment bath containing the required enzyme in the form of a solution is suitably used for this purpose. The treatment may be carried out at a slightly elevated temperature, e.g. at 40° C., to accelerate detachment and solution of the layers. The temperature at which the enzyme develops its maximum enzyme activity can easily be determined by simple test series. The components of the dissolved layers, e.g. silver and silver halide, colour-providing compounds, dyes, mordants and degradation products of the binders contained in the layers, accumulate in the treatment solution, which may then be recycled for the recovery of valuable raw materials.

EXAMPLE 1

The decomposability of various dye absorbent layers containing a mordant and gelatin was determined in dependence upon the hardening.

For this purpose, various image receptor sheets A to F containing the components shown in Table 1 were prepared by application to a polyethylene-coated paper support 6. The quantities given are based on 1 $m^2$. The gelatin content and mordant content were each 2.5 g and the content of hardener was 0.05 g.

TABLE 1

| Sheet | Mordant | Hardener | Decomposition time [min] |
|---|---|---|---|
| A | 1 | HS-4 | >15 |
| B | 1 | HS-1 | 4 |
| C | 1 | HS-1 | 2 |
| D | 2 | HS-7 | 2 |
| E | 2 | HS-4 | >15 |
| F | 2 | HS-1 | 0.5 |
| G | 2 | HS-7 | >15 |

Sheets A to F were then coloured with a dye corresponding to the following formula:

Dye 1

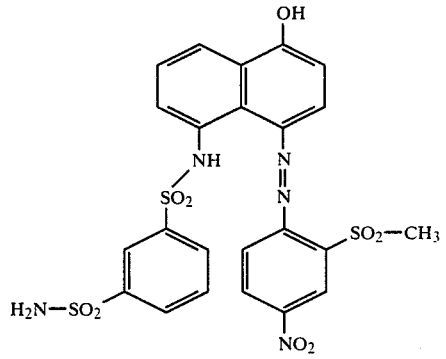

and were placed in a bath of a 2% aqueous trypsin solution at pH 8 to 8.5 at 40° C. The decomposition time entered in Table 1 is the time required for decomposition of the layer in the bath indicated. The decomposition time of layers containing gelatin can be varied within wide limits by varying the hardener and the mordant. Layers having a long decomposition time, preferably 15 minutes, are suitable for the first dye absorbent layer while the second dye absorbent layer should have a short decomposition time, preferably 2 minutes or less.

EXAMPLE 2

The test described above for determining the strength of mordant was carried out on mordants 1 and 2 and dyes 1, 2 and 3, mordant 2 being used as a standard. The dye absorbent layer prepared using mordant 1 was found to have K-values below 1 with all three dyes. This means that mordant 1 is suitable for the second dye absorbent layer and mordant 2 for the first dye absorbent layer.

Dye 2

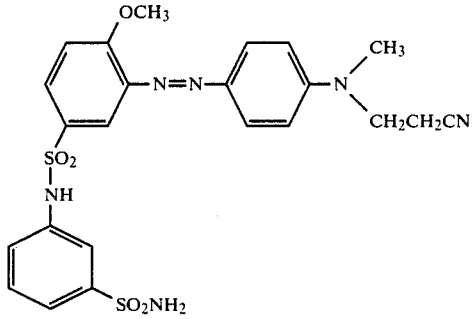

-continued

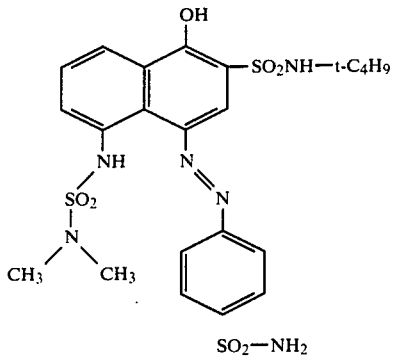

EXAMPLE 3

A light-sensitive element of a photographic recording material according to the invention was prepared by applying the following layers successively to an opaque, polyethylene laminated paper support. The quantities given are based in each case on 1 $m^2$.

1. Mordant layer containing 2.0 g of mordant 2 and 3.4 g of gelatin.
2. Red sensitized silver iodochlorobromide emulsion prepared from 0.5 g of $AgNO_3$ with 1.0 g of gelatin 0.2 g of dye releaser 1 (cyan) and 0.11 g of ED compound 1.
3. Developer layer containing 0.05 g of developer compound 1 and 0.39 g of gelatin.
4. Mordant layer containing 2.0 g of mordant 1 and 3.4 g of gelatin.
5. Hardening layer containing 0.6 g of hardener 3 and 0.3 g of gelatin.

The following activator was used for development:

40 g KOH
3 g KBr
25 g 2-methyl-2-propyl-1,3-propanediol
20 g 1,4-cyclohexanedimethanol (50%)
912 g water.

The combination of layers was exposed behind a grey wedge, developed in the activator for 2 minutes, treated for 2.5 minutes at 40° C. in the after-treatment bath already described (2% trypsin solution, pH 8.5) and washed for 5 minutes. A positive cyan image was obtained. Layers 2 to 5 were completely decomposed; layer 1 remained intact. No discolouration of activator was observed.

Dye-releaser 1

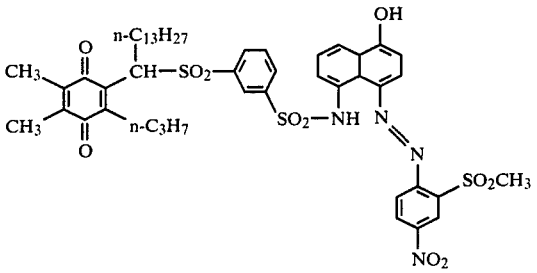

Developer compound 1

-continued

Dye 3

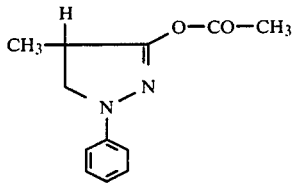

ED-Compound 1

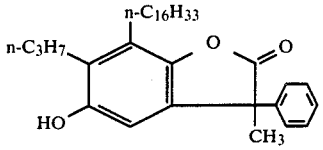

EXAMPLE 4

A light-sensitive element of a photographic material according to the invention was prepared by applying the layers indicated below to an opaque polyethylene laminated paper support. The quantities indicated are based in each case on 1 $m^2$.

1. Mordant layer containing 2 g of mordant 2 and 3.4 g of gelatin. 0.07 g of HS-2 (alkali-resistant hardener) wad used as hardener. The layer was hardened for 2 days at 45° C. and 50% relative humidity.
2. Red-sensitized silver iodochlorobromide emulsion prepared from 0.5 g of $AgNO_3$ with 1.0 g of gelatin, 0.2 g of dye releaser 1 (cyan) and 0.11 g of ED-compound 1.
3. Developer layer containing 0.05 g of developer compound 1 and 0.39 g of gelatin.
4. Mordant layer containing 2 g of mordant 1 and 3.4 g of gelatin.
5. Protective layer containing 0.3 g of geltain. 1–5% of an alkali-labile hardener indicated in Table 2, based in each case on the quantity of gelatin, were added to the casting solutions for layers 2 to 5. The same activator as in Example 3 was used for development.

The combination of layers was exposed behind a grey wedge, treated with activator at 20° C. for one minute and then washed with water at 18° C. for 3 minutes. Layers 2 to 5 were washed off with water at 50°–60° C. No trace of layers 2 to 5 adhered to the positive cyan image obtained. Layer 1 remained intact.

The results are shown in Table 2.

TABLE 2

| Alkali labile hardener | Layer melting point Layers 2–5 Before/After Processing | | Removability with water at 60° C. Layers 2–5 |
|---|---|---|---|
| 5% HL-6 | 100° C. | 43° C. | complete |
| 1% HL-9 | 100° C. | 43° C. | " |
| 1% HL-14 | 100° C. | 43° C. | " |

We claim:

1. A photographic dye diffusion transfer process for the production of colour images, in which a colour photographic recording material consisting of a layer support and, arranged thereon, a combination of layers comprising at least one dye absorbent layer capable of being coloured by diffusible dyes and a light-sensitive element which is removably connected to the dye absorbent layer and has at least one spectrally sensitized silver halide emulsion layer and at least one colour-providing compound associated therewith is exposed imagewise and developed, whereupon the light-sensitive element is removed from the dye absorbent layer, characterised in that the recording material is subjected to a layer decomposing treatment after development and that the recording material used is one in which the light-sensitive element is decomposed by the layer decomposing treatment while the dye absorbent layer arranged on the layer withstands this treatment.

2. A process as claimed in claim 1, wherein a proteolytic enzyme is used for the layer decomposing treatment and the recording material used is one in which the light-sensitive element is decomposed by treatment with the proteolytic enzyme while the dye absorbent layer arranged on the layer support withstands this treatment.

3. A process as claimed in claim 2, wherein the proteolytic enzyme used is trypsin.

4. A process as claimed in claim 2, wherein the recording material used is one in which the dye absorbent layer arranged on the layer support either contains no binder or contains a binder which is substantially free from peptide bonds.

5. A process as claimed in claim 2, wherein the recording material used is one containing, in the dye absorbent layer arranged on the layer support, a proteinaceous binder which has been hardened or cross-linked so that it undergoes comparatively little decomposition by the treatment with the proteolytic enzyme.

6. A colour photographic recording material for the production of colour images by the dye diffusion transfer process, consisting of a layer support and, arranged thereon, a combination of layers comprising at least a first dye absorbent layer capable of being coloured by diffusible dyes, and detachably connected with this dye absorbent layer, a light-sensitive element having at least one spectrally sensitized silver halide emulsion layer and at least one colour-providing compound associated therewith, and a second dye absorbent layer arranged above the light-sensitive element, wherein said first dye absorbent layer is firmly attached to the layer support and consists of a material which is subject to comparatively little decomposition by treatment with a proteolytic enzyme, and the binder of the layers of said light-sensitive element and of said second dye absorbent layer consist of a material which is comparatively readily decomposed by treatment with the same enzyme, and wherein said second dye absorbent layer has less mordanting capacity than said first dye absorbent layer.

7. A recording material as claimed in claim 6, wherein the first dye absorbent layer, arranged closest to the layer support, either contains no binder or contains a binder which is substantially free from peptide bonds.

8. A recording material as claimed in claim 6, wherein the first dye absorbent layer, arranged closest to the layer support, contains a proteinaceous binder which has been hardened or cross-linked so that it undergoes comparatively little decomposition by the treatment with the proteolytic enzyme.

* * * * *